US005526432A

United States Patent [19]

Denenberg

[11] Patent Number: 5,526,432

[45] Date of Patent: Jun. 11, 1996

[54] DUCTED AXIAL FAN

[75] Inventor: Jeffrey N. Denenberg, Trumbull, Conn.

[73] Assignee: Noise Cancellation Technologies, Inc., Linthicum, Md.

[21] Appl. No.: 335,271

[22] Filed: Oct. 11, 1994

Related U.S. Application Data

[63] Continuation-in-part of Ser. No. 64,598, May 21, 1993, abandoned.

[51] Int. Cl.[6] ..... G10K 11/16

[52] U.S. Cl. ..... 381/71; 415/119

[58] Field of Search ..... 381/71, 94; 415/119

[56] References Cited

U.S. PATENT DOCUMENTS

| | | | |
|---|---|---|---|
| 4,044,203 | 8/1977 | Swinbanks | 381/71 |
| 4,153,815 | 5/1979 | Chaplin et al. | 381/71 |
| 4,715,559 | 12/1987 | Fuller | 381/71 |
| 5,141,391 | 8/1992 | Acton et al. | 415/119 |

FOREIGN PATENT DOCUMENTS

| | | | |
|---|---|---|---|
| 63-74399 | 4/1988 | Japan | 381/71 |
| 3-13998 | 1/1991 | Japan | 381/71 |
| WO92-17936 | 10/1992 | WIPO | 381/71 |

*Primary Examiner*—Forester W. Isen

[57] ABSTRACT

A ducted axial fan for large diameter ducts (11) which includes equidistantly spaced sensors (22,23) upstream and downstream of an axial fan and spaced actuators (24, 26) located around the periphery of said duct to cancel tonal noise caused by the air turbulence generated by the rotation of the fan.

10 Claims, 2 Drawing Sheets

DUCTED AXIAL FAN

This is a continuation-in-part of Ser. No. 08/064,598, filed May 21, 1993, now abandoned.

This invention relates to a ducted axial fan. These fans are known to generate tonal noise at harmonics of the rotation rate times the number of blades in the fan as well as some random noise from air turbulence. It is also well documented that most of the noise is generated at the tips of the blades and that the tonal components increase rapidly in intensity when the fan must work against back pressure.

Prior efforts to solve this problem through active cancellation have been limited to cases where the diameter of the duct is small and its length long with respect to a wavelength of the tonal noise. This allows for effective coupling of the anti-noise from a small number of speakers in the duct with the non-rotating noise field downstream in the duct.

The instant invention solves the problems inherent in the situation where the diameter of the fan is large when compared to a wavelength of the tonal noise from the blade tips. This occurs whenever the fan is large, rotating at high speed and/or has a high number of blades.

OBJECTS OF THE INVENTION

Accordingly, it is an object of this invention to improve upon the prior art in active axial fan noise cancellation to handle cases where the diameter of the fan is large compared to a wavelength of the tonal noise from the blade tips.

This and other objects will become apparent when reference is had to the accompanying drawings in which.

DESCRIPTION OF THE INVENTION

This invention recognizes that the predominant perceived tonal noise from a ducted axial fan is the secondary acoustical wave generated when the rotating pressure wave produced by the fan hits physical supporting members near the fan. Most of the work to date in active control of fan noise cancels this secondary acoustical wave. It has proven difficult to accomplish this cancellation when the dimensions of the fan and/or duct are large (more than ¼λ) compared to the wavelength (λ,) of the noise due to the complexity of dealing with the multiple propagation modes that the acoustical wave can use to travel down the duct.

The primary pressure wave is different on each side (inlet/outlet) of the axial fan. On both sides it is a maximum at the blade tips (mostly due to the higher speed of the blades at the tips) and is almost zero at the axis of the fan. One solution would then be to position a set of speakers around the duct at or near the plane of the fan and operate a multiple interacting algorithm (MISACT) to cancel the noise. The required number of speakers is determined by the complexity of the pressure waveform around the circumference of the duct but will be a minimum of two per fan blade for smaller fans and more for fans with larger diameters.

Figure 1:
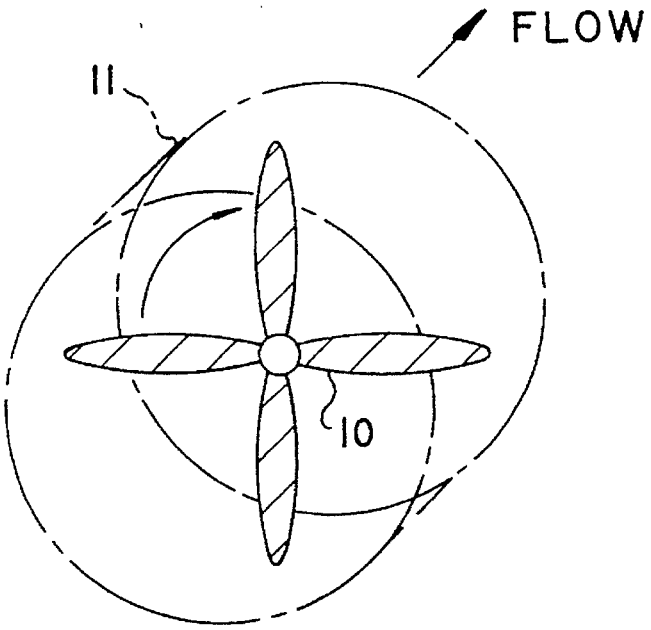
FIG. 1 is a perspective view of a general configuration of a typical ducted axial fan.

FIG. 1 shows an axial four-bladed fan 10 adapted to rotate within duct 11. The tips 12 of blades 13 of fan 10 generate tonal noise at harmonics of the rotation rate times the number of blades in the fan as well as random noise from air turbulence.

Figure 2:
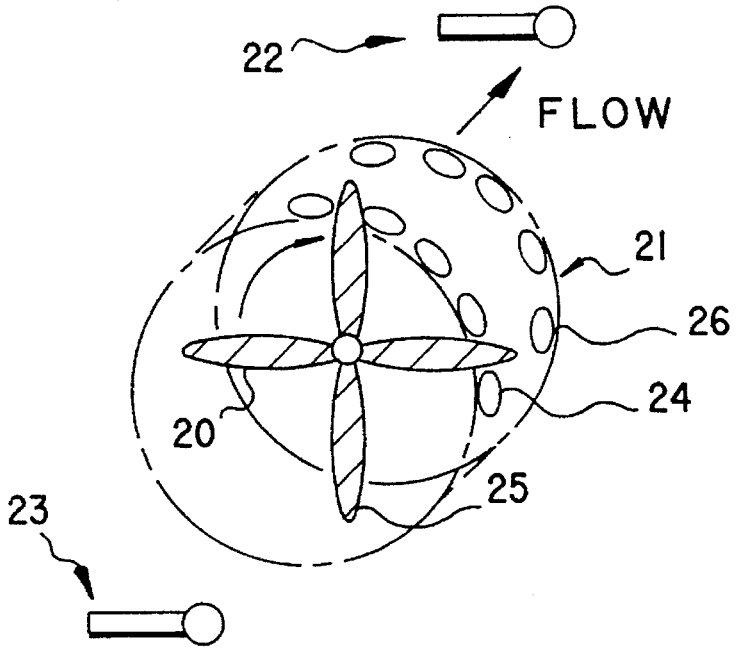
FIG. 2 is a perspective view of the ducted axial fan comprising the instant invention.
Figure 3:
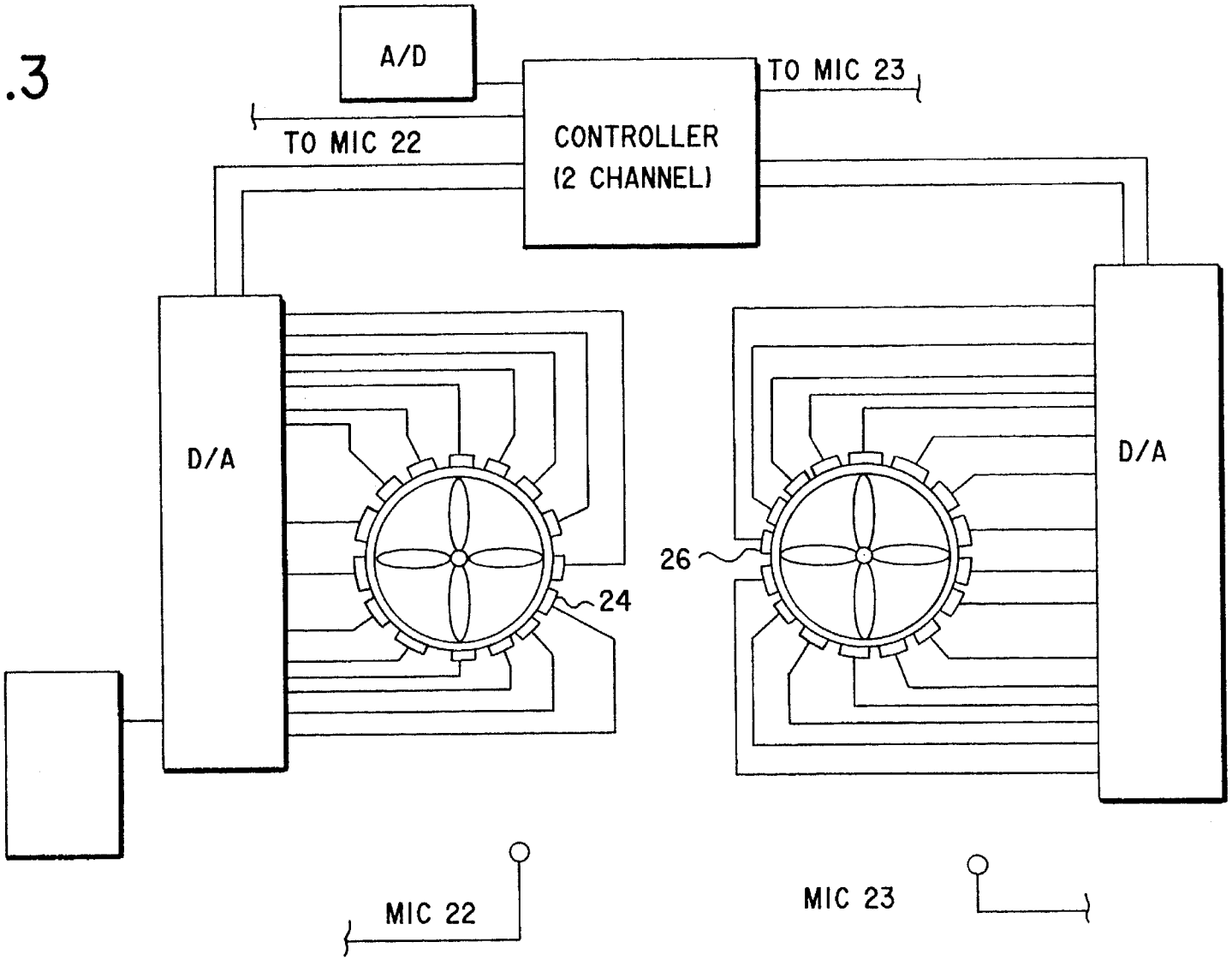
FIG. 3 shows a bi-directional controller.

In general, the propagating pressure wave is different on either side of the fan. This will require twice as many speakers and that they be in pairs, on either side of the fan and double the number of cancellation channels. FIG. 2 shows a diagram of the physical actuator system.

In FIG. 2, the fan 20 having blade tips 25 is adapted to rotate within duct 21, microphones 22, 23 are located downstream and upstream, respectively and a series of actuators, e.g., speakers 24, are located around the periphery of duct 21. In cases where the pressure waves are different on opposite sides of the fan, a second set of actuators 26 are located around the duct periphery of duct 10. It should be noted that all the speakers are equally spaced around the duct.

Since the noise sources (fan tips) 25 are close to the anti-noise speakers, the frequency limits are not as severe as the limits in matching acoustical modes. Since some noise is also generated along the length of the blades, this approach may not achieve perfect cancellation at higher frequencies, but it should generally do a good job.

To control the speakers, one can employ a system as shown and described in U.S. Pat. No. 5,091,953, hereby incorporated by reference herein. This system is known as a MISACT (Multiple Interacting Sensors and Actuators) system.

One problem with a direct application of MISACT to this problem is the complexity and speed of the calculations required to implement that solution to this problem. Recognizing that the rotating pressure wave has a slowly changing (almost unchanging) shape, an alternate solution is feasible. Therefore an anti-noise generating element is used which has one channel of active control (two channel MISACT for bi-directional cancellation) to determine the shape of the required anti-pressure wave and then output a replicated (by the number (N) of fan blades) version of this shape rotating around the set of speakers in sync with the fan rotation. A bi-directional system requires only a two channel MISACT controller with an added function to do the synchronous time to spacial transformation. The MISACT controller will need to have a number of D/A output channels (and amplifiers) equal to the number of speakers per fan blade. It will only require two A/D input channels (assuming no serious propagation mode problems at the microphones).

The generation of the rotating sound field is a straight forward addition to a MISACT controller. The present MISACT system generates an image of the required anti-noise output wave form and stores it in memory. It then reads this memory in a rotating cycle, synchronous with the noise cycle. All that is needed here is to read the output wave form with N different pointers (N being the number of speaker pairs per fan blade) that are equally spaced around the anti-noise cycle. The resulting 2*N output signals are then each amplified and distributed to a number of speakers equal to the number of fan blades.

Since the anti-noise output waveform is slowly varying, the update algorithm can be slowed down to maintain stability in the presence of the non-linear relationship between the generated anti-noise waveform and the residual noise sensed by the microphone on each side of the form.

Having described the invention, attention is directed to the appended claims.

I claim:

1. In a duct having a multi-bladed axially mounted fan means with multiple blades and an intake side and an exhaust side mounted therein creating a rotating sound field, the improvement comprising a first sensor means mounted upstream of said fan means, a second sensor means mounted downstream of said fan means, a series of actuator means mounted around said duct means adjacent said fan means, and a two channel control means operatively connected to said actuator means and said first and second sensor means and adapted to directly cancel the tonal noise generated by said axial fan by canceling the pressure waves generated by said fan's rotation by generating different rotating pressure antiwaves on each side of the blade so that noise propagates from both the exhaust and intake sides of the fan to quiet said rotating sound field.

2. As in claim 1 wherein said actuator means comprise a series of speakers mounted inside the duct means.

3. As in claim 2 wherein said speakers are spaced equidistant from one another.

4. As in claim 1 wherein said actuator means comprises two sets of speakers mounted in said duct, each set mounted adjacent said axially mounted fan so as to be adapted to directly cancel the pressure waves generated by the fan's rotation on either side.

5. As in claim 4 wherein said control means is adapted to do a synchronous time to spacial transformation.

6. As in claim 1 wherein said actuator means comprises one set of speakers mounted in said duct, said speaker means mounted adjacent said axially mounted fan so as to be adapted to directly cancel the pressure waves generated by the fan's rotation on one side by generating a pressure gradient around said duct that has a shape opposite to the pressure gradient formed by the moving fan blades.

7. As in claim 6 wherein said actuator means comprises a series of speakers mounted inside the duct means.

8. As in claim 7 wherein said speakers are spaced equidistant from one another.

9. In a duct having an intake and exhaust, said duct having a multi-bladed axially mounted fan therein, said fan having a large diameter in relation to a wavelength of the tonal noise from the blade tips to create a rotating sound field, the improvement comprising:

a first sensor means mounted adjacent said fan means, a series of actuator means mounted around said duct in an annular configuration adjacent said fan means, and a two channel control means operatively connected to said actuator means and said first sensor means and adapted to cancel the tonal noise generated by said axial fan by canceling the pressure waves generated by said fan's rotation by generating different rotating pressure antiwaves on each side of the blade so that noise propagates from both the exhaust and intake sides of the fan to thereby quiet said rotating sound field.

10. As in claim 9 wherein there is a second sensor means mounted adjacent said fan on the side opposite from said first sensor means and said series of actuator means comprise two annular configurations thereof one of each side of said fan.

* * * * *